US006761558B1

(12) United States Patent
Kim

(10) Patent No.: US 6,761,558 B1
(45) Date of Patent: Jul. 13, 2004

(54) HEATING APPARATUS USING THERMAL REACTION OF BROWN GAS

(76) Inventor: Sang-Nam Kim, 23-3 Cheong-Dong, Kangnam-ku, Seoul (KR), 135-102

( * ) Notice: Subject to any disclaimer, the term of this patent is extended or adjusted under 35 U.S.C. 154(b) by 0 days.

(21) Appl. No.: 10/110,557

(22) PCT Filed: Aug. 22, 2000

(86) PCT No.: PCT/KR00/00942

§ 371 (c)(1),
(2), (4) Date: Apr. 12, 2002

(87) PCT Pub. No.: WO02/16833

PCT Pub. Date: Feb. 28, 2002

(51) Int. Cl.[7] ..... F23C 6/04

(52) U.S. Cl. ..... 431/4; 431/2; 431/7; 431/126; 431/328; 431/353; 431/346; 126/91 R; 126/92 AC

(58) Field of Search ..... 431/3, 4, 170, 431/7, 5, 126, 268, 350, 352, 10, 2, 328, 353, 346; 126/91 R, 91 AC; 48/192, 199 FM, 197 FM, 203

(56) References Cited

U.S. PATENT DOCUMENTS

| | | | | | |
|---|---|---|---|---|---|
| 132,793 | A | * | 11/1872 | Barnes | 431/347 |
| 558,176 | A | * | 4/1896 | Huber | 431/208 |
| 854,497 | A | * | 5/1907 | Henzel | 126/116 R |
| 900,303 | A | * | 10/1908 | Panasevitch | 126/90 R |
| 1,218,206 | A | * | 3/1917 | Panasevitch | 126/85 R |
| 1,273,050 | A | * | 7/1918 | Euler | 205/628 |
| 1,663,722 | A | * | 3/1928 | Nuer | 126/85 R |
| 1,825,970 | A | * | 10/1931 | Mesinger | 48/192 |
| 2,098,629 | A | * | 11/1937 | Knowlton | |
| 2,161,700 | A | * | 6/1939 | De Motte | 48/192 |
| 3,262,872 | A | * | 7/1966 | Rhodes et al. | 204/272 |
| 3,385,647 | A | * | 5/1968 | Miller et al. | 431/4 |
| 3,706,662 | A | * | 12/1972 | Wellford, Jr. | 210/748 |
| 3,784,096 | A | * | 1/1974 | Zweifel | 237/1 R |
| 3,924,648 | A | * | 12/1975 | Etter | 137/3 |
| 4,014,777 | A | * | 3/1977 | Brown | 204/228.5 |
| 4,465,455 | A | * | 8/1984 | Meyer | 431/27 |
| 5,082,544 | A | * | 1/1992 | Willey et al. | 204/270 |
| 5,244,558 | A | * | 9/1993 | Chiang | 204/241 |
| 5,279,260 | A | * | 1/1994 | Munday | 122/5 |
| 6,193,874 | B1 | * | 2/2001 | Chern | 208/15 |
| 6,397,834 | B1 | * | 6/2002 | Kim | |
| 6,443,725 | B1 | * | 9/2002 | Kim | |

FOREIGN PATENT DOCUMENTS

| | | | | |
|---|---|---|---|---|
| DE | 38 38 142 | * | 5/1990 | |
| FR | 2235092 | * | 1/1975 | 431/2 |

(List continued on next page.)

*Primary Examiner*—Carl D. Price
(74) *Attorney, Agent, or Firm*—Pendorf & Cutliff

(57) ABSTRACT

The present invention relates to a heating apparatus using thermal reaction of brown gas. After brown gas generated from a brown gas generator passes hexane liquid in a flame arrester, it is burnt in a brown gas burner located at a lower portion of a heating element. Heating members are installed in multi-stage inside a heating element body of a hollow form. The heating element body located at each stage includes vent holes and exhaust openings. A cover is disposed on the top of the heating element. The heating member located at the lower portion is heated by flame of the brown gas, and then also the heating member located at an upper portion is heated by flame of high temperature caused by the thermal reaction of the brown gas, which gradually heats the lower heating member. After all, the whole heating members are heated to emit a vast heat. The heating device according to the present invention is very useful as a heat source for all brown gas boilers, heaters, heating furnaces and warm air circulators and can contribute to environmental preservation by making a purified energy, which does not induce environmental pollution.

3 Claims, 4 Drawing Sheets

FOREIGN PATENT DOCUMENTS

| | | | | |
|---|---|---|---|---|
| JP | 53-113802 | * | 10/1978 | 431/4 |
| JP | 53-114803 | * | 10/1978 | 431/4 |
| JP | 63-304093 | * | 12/1988 | 431/4 |
| JP | 406011106 | * | 1/1994 | 431/2 |
| JP | 406241415 | * | 8/1994 | 431/2 |
| JP | 10-253017 | * | 9/1998 | |
| JP | 11-21572 | * | 1/1999 | 431/2 |
| JP | 11-246984 | * | 9/1999 | 431/2 |
| JP | 2000-039128 | * | 2/2000 | |
| JP | 2000-161017 | * | 6/2000 | |

* cited by examiner

HEATING APPARATUS USING THERMAL REACTION OF BROWN GAS

CROSS REFERENCE TO RELATED APPLICATION

This application is a national stage of PCT/KR00/00942 filed Aug. 22, 2000.

BACKGROUND OF THE INVENTION

FIELD OF THE INVENTION

The present invention relates to a heating apparatus using thermal reaction of brown gas, and more particularly, to a heating apparatus using brown gas, which is purified fuel, instead of typically used fossil fuel.

Brown gas means mixture of gases wherein hydrogen and oxygen produced by electrolytic analysis of water are mixed in mixture ratio of 2:1. Only the brown gas has four peculiar properties, that is, (1) complete non-pollution, (2) complete combustion, (3) implosion and (4) thermal reaction; and, thereby, it is very ideal fuel to be highlighted as purified fuel in a new age.

As the brown gas has a condition for complete combustion of hydrogen and oxygen in chemical equivalent ratio of 2:1, it does not need an additional air supply device and chimney for oxygen supply as in conventional combustion methods.

If the brown gas is used for heating, since ventilation is not required, there is an energy saving effect. Moreover, the brown gas also has a humidification effect by being created to vapor after combustion, thereby providing a pleasant heating.

However, in the past, as a suitable method for burning the brown gas was not found, and, thereby, economical methods could not be obtained, the brown gas was not used as fuel.

The reasons are as follows:

First, as the brown gas is fast in a burning speed, it is possible to cause flashback or backfire phenomenon.

A water sealing type flame arrester could prevent the backfire phenomenon; however, fire of a burner has put out every backfire. Therefore, if the backfire problem is not solved basically, it is difficult to use the brown gas as fuel.

Second, gas produced by the electrolytic analysis of water is called hydrogen gas. As required, heat could not be obtained even when the hydrogen gas is burned by inspiring the air in a combustion chamber of a typical boiler by one of conventional methods; no one achieved success for the past 170 years of the electrolytic analysis. It is natural because no one knew the peculiar properties of the brown gas.

Thus, to burn the brown gas, a new way that is different from the conventional ways must be taken for burning the brown gas. Therefore, through understanding the peculiar properties of the brown gas, the present invention is to provide a heating apparatus by a new combustion method applying the peculiar properties of only the brown gas.

To explain it in more detail, four peculiar properties and safety of the brown gas will be explained hereinafter as follows.

FOUR PROPERTIES OF THE BROWN GAS (1) Complete non-pollution: As the brown gas is produced in water and reduced to vapor after combustion, it does not cause any pollutants.

(2) Complete combustion: As being a mixture of gases mixed in a mixture ratio of 2:1 of which is the chemical equivalent ratio of hydrogen 2 to oxygen 1, the brown gas in itself contains oxygen sufficient for complete combustion.

(3) Thermal reaction: The brown gas dissociates water into hydrogen atom and oxygen atom and keeps them in a mixed state without separating them from each other. When burning, the brown gas has a peculiar property that flame is made by reaction of the atoms and hydrogen and oxygen being in molecular condition. The hydrogen atom and the oxygen atom penetrate into atomic nuclei of subject materials for heating. The materials heated by the thermal reaction of hydrogen and oxygen are heated by still a hotter flame than flame generated when gas in itself is burned in the air. The brown gas melts aluminum at 700 degrees well, and vaporizes tungsten, generating heat of 6000 degrees. As the above, the brown gas, which has different thermal reactions according to the subject materials for heating, can melt brick and iron, as they are welded together.

(4) Implosion: A brown gas generator generates brown gas of about 1,860 l with water of 1 l. To the contrary, if the brown gas of 1,860 l is burned by spark within a sealed pressure vessel, a pressure drop occurs and volume reduction into one over a thousand eight hundred and sixty is caused with implosion of low pressure so as to form vacuum level as soon as maximum value of pressure, 0.5 Mpa, is reached for forty four over millionth seconds of an explosion period of time. That is, water of 1 l is produced again and the remaining volume is in a vacuum condition. This is called an implosion that is quite different from an explosion.

The flame generated when the brown gas is burned may be accepted as a process that the implosion is continued. Therefore, the flame is in the form of pinpointed flame, which goes straight on without bursting, and the length of the flame may be up to 400 mm.

STUDY OF SAFETY OF THE BROWN GAS

The brown gas has to be safe above all to be used as fuel. Reasons that the brown gas is safe will be explained as follows.

First, the brown gas generator begins to generate gas as soon as a switch is turned on and is operated only in pressure of 1 kg/cm$^2$ by a pressure control loop system. Therefore, the maximum pressure of the brown gas in use is no more than 1 kg/cm$^2$.

In other words, the brown gas is safe as consumed immediately when generated without compression and storage.

Second, as being lighter than air, the brown gas disappears easily without being latent indoors even though the gas is leaked out. Therefore, there is no explosion accident as in LPG.

Third, as previously described, when the mixture of hydrogen and oxygen that is mixed in the mixture ratio of 2:1 is burned, there is a serious hazard caused by a violent explosion. However, the brown gas is absolutely safe by the implosion property. Even if there occurs the backfire phenomenon by the flame's backward movement from the burner in the combustion chamber, the brown gas, which fills some spaces such as pipe lines or a tank for supplying the brown gas, is burned all at the same time with a bang, but there occurs an internal shock wave by the implosion property to put out the fire. Therefore, differently from the typical LPG and acetylene gases, as no fire occurs, the brown gas can be used by igniting it in itself again.

In general, people associate gas with explosion accidents. However, as described above, because it was proved in theory and practice that the brown gas is absolutely safe, people may use it with a sense of security.

SUMMARY OF THE INVENTION

It is, therefore, an object of the present invention to provide a heating apparatus using thermal reaction of brown gas, which overcomes the problems of the prior arts.

When the burning rate of the brown gas is delayed by using Hexane ($C_6H_{14}$) of hydrocarbon series as antibackfire liquid in a water ring type flame arrester, the backfire does not occur fundamentally. As a brown gas burning device, heating members are installed in multi-stages inside a heating element body of a hollow form. The heating element body located at each stage includes vent holes and exhaust openings in the surface and a cover for covering the top thereof. First, the heating member located at a lower portion is heated by the brown gas flame, and then, also the heating member located at an upper portion is heated by a flame of high temperature caused by the thermal reaction of the brown gas, which gradually heats the heating element. After all, the whole heating element is heated to emit a vast heat.

In more detail, as the flame of the brown gas in itself continues the implosion, it makes the pinpoint flame naturally and thereby heat is concentrated on one spot so that the flame does not spread and there is no lateral heat.

Therefore, the present invention is to make a vast heat by inducing the thermal reaction by directly heating the heating members without using the brown gas being in a flame state.

At this time, the heating members are made of nickel-chromium alloy, aluminum-chromium alloy or alumina ceramics in the form of a flat bar, nichrome wire, ceramic cylinder and ceramic ball.

The present invention adopts the water ring type flame arrester as means for antibackfire and uses the hexane ($C_6H_{14}$) liquid as antibackfire liquid. After that, a small amount of the hexane being in the form of vapor is mixed with the brown gas.

At this time, the hexane, which can reduce the burning speed of the flame, can certainly prevent the flash back or the backfire.

Furthermore, as the consumed hexane replenishes heat quantity while being burned with the brown gas, it is used very effectively as well as having the antibackfire effect.

However, the hexane, which is one of the hydrocarbon series, has a portion, which remains without burning in the brown gas burner. This is why the hexane mixed in the form of vapor must be burned by oxygen in the air because oxygen is consumed by self-combustion without any remaining oxygen.

Therefore, in the present invention the heating element is installed vertically so that the air from the lower portion is induced naturally to flow upwardly. After that, if the hexane incompletely burnt in part remains, it is burnt completely inside the heat element of high temperature.

Therefore, according to the present invention, the brown gas is burnt stably by using the hexane and the heating element for a brown gas according to the present invention having the peculiar properties of only the brown gas are installed, so that a vast heat is emitted only by a small amount of the brown gas. The present invention can be used not only in a heating device such as a heater, but also as heat source for a boiler, a heating furnace, an incinerator, a warm air circulator, and the likes.

BRIEF DESCRIPTION OF THE DRAWINGS

Further objects and advantages of the invention can be more fully understood from the following detailed description taken in conjunction with the accompanying drawings, in which.

DETAILED DESCRIPTION OF THE PREFERRED EMBODIMENT

The present invention will now be described in connection with preferred embodiments with reference to the accompanying drawings.

Figure 1:
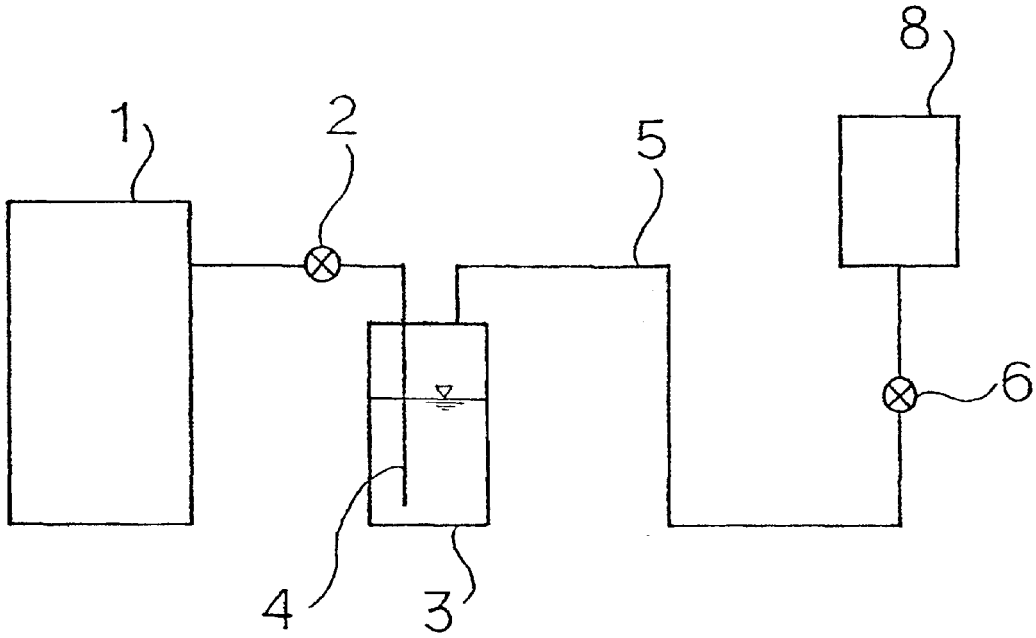
FIG. 1 is a schematic view of the present invention.
Figure 2:
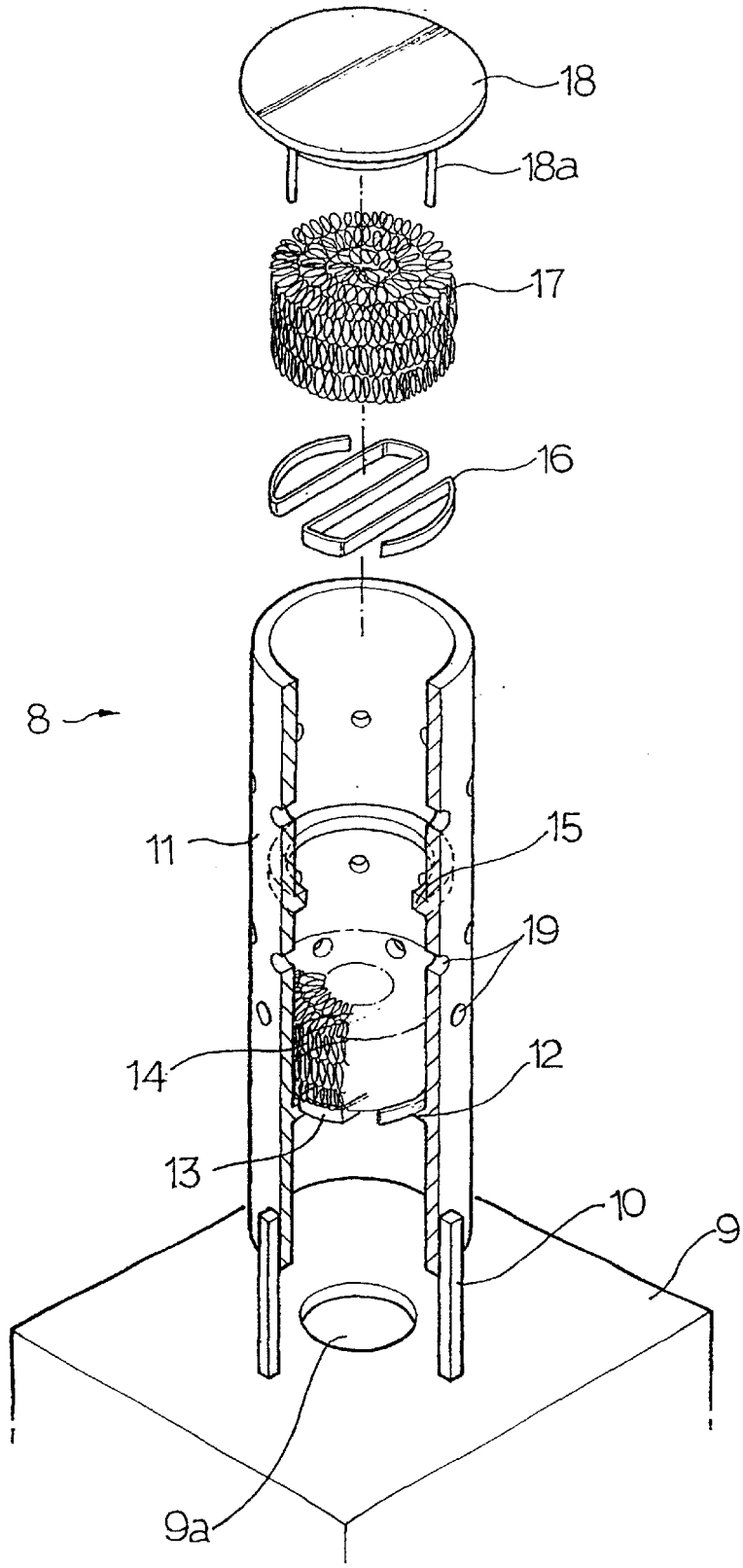
FIG. 2 is a perspective view of a heating element of the present invention.
Figure 3:
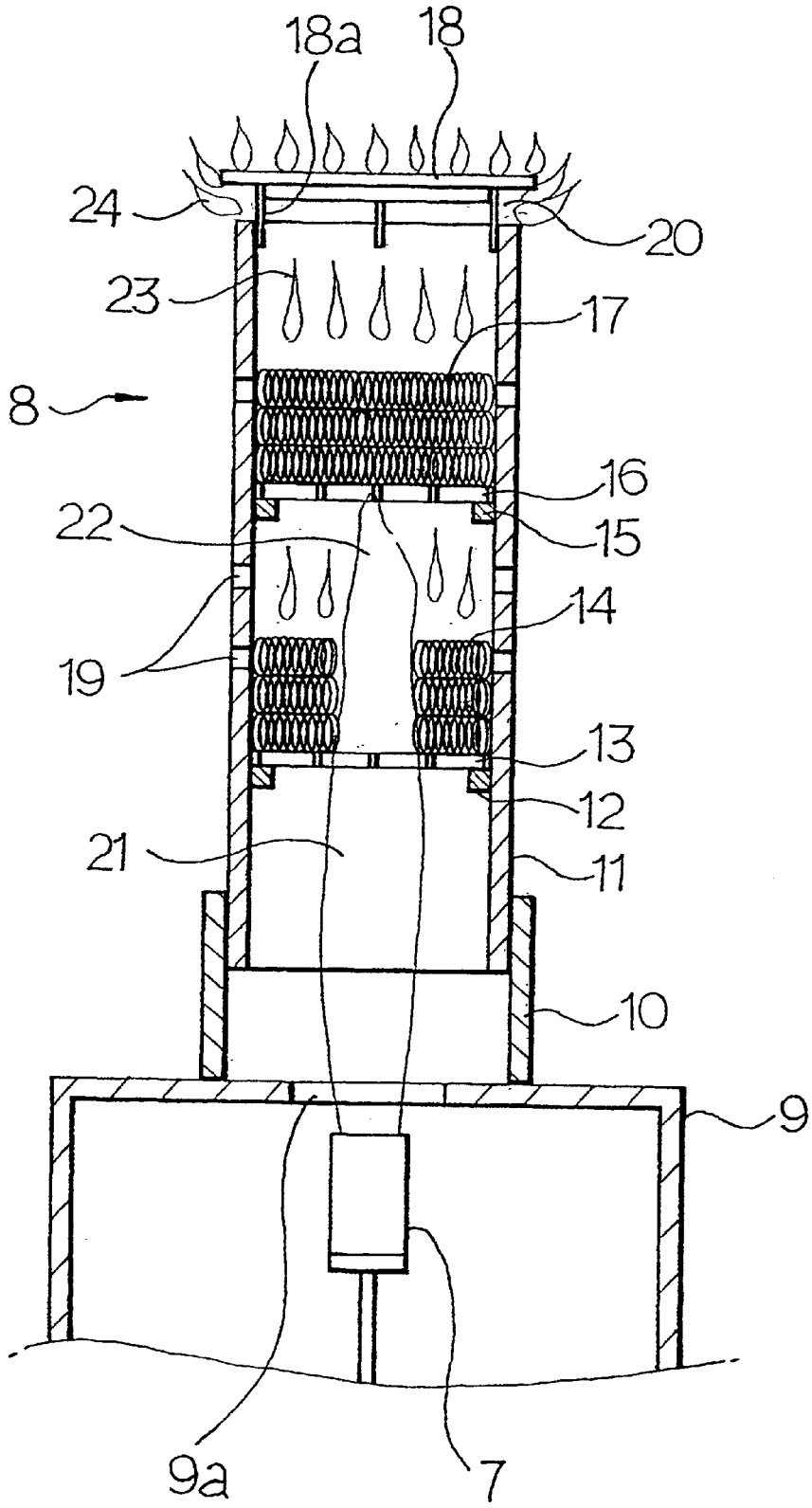
FIG. 3 is a sectional view of the heating element of the present invention.
Figure 4:
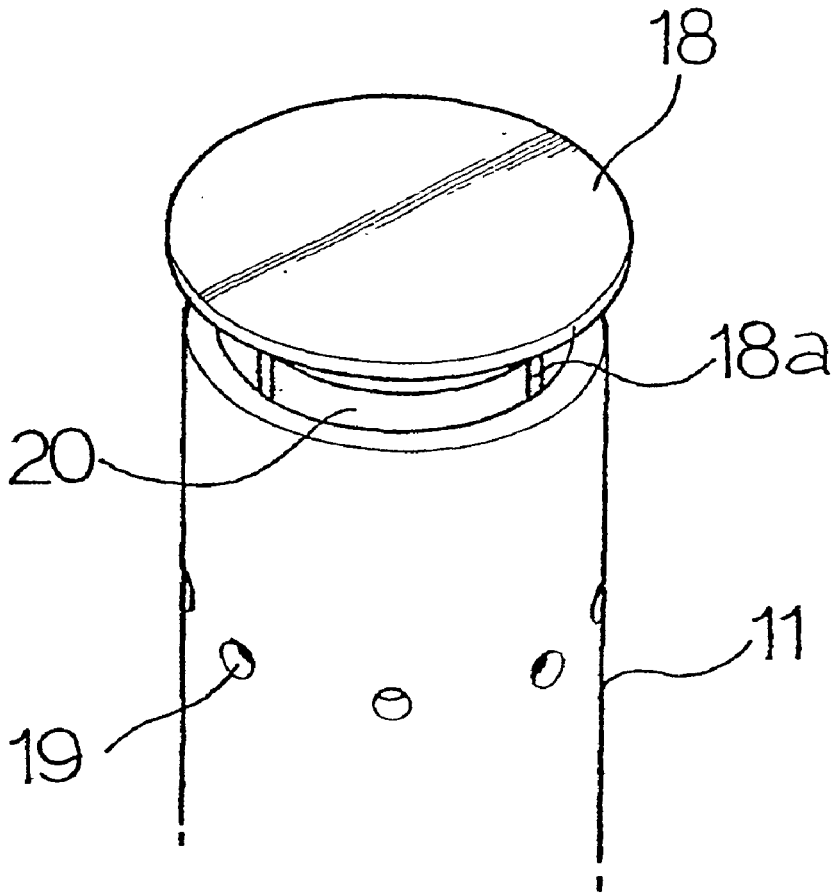
FIG. 4 is a perspective view showing an upper portion of the heating element in more detail.

FIG. 1 is a schematic view of a brown gas heating element and a brown gas generator of the present invention, FIG. 2 is a perspective view of the heating element, FIG. 3 is a sectional view showing an internal structure of the heating element and FIG. 4 is a perspective view showing an upper portion of the heating element in more detail.

FIGS. 1 to 4 illustrate the brown gas generator according to a preferred embodiment of the present invention. Brown gas produced in the brown gas generator 1 is led into a water ring type flame arrester 3 through a gas digestion tube 4 by a manipulation of a first valve 2 of a gas supply tube 5. After that, the brown gas passes hexane liquid used as antibackfire liquid, and than, is provided to a brown gas heating element 8 by a manipulation of a second valve 6 of the gas supply tube 5.

At this time, while the gas passes the flame arrester 3, a small amount of hexane being in the form of vapor is mixed with the brown gas to delay a burning speed, thereby preventing backfire or flash back phenomenon.

The brown gas heating element 8 includes a burner 7 mounted inside, a stand 9 having a burner hole 9*a*, and a heating element body 11 of a hollow form which is installed on the stand 9 and supported by a plurality of supporters 10. A lower portion of the heating element body 11 includes a shelf 13 made by bending a flat bar and located inside, a prop 12 located on an inner surface of the heating element body 11 for supporting the shelf 13 and a heating member 14 of a fan shape sitting on the shelf 13.

Also, an upper portion of the heating element body 11 includes a prop 15, a shelf 16 and a heating member 17, which are installed in turn. A difference between the lower heating member 14 and the upper heating member 17 is as follows. The lower heating member 14 has a small opening formed at the center thereof to make a portion of flame 21 of the brown gas directly approach the upper heating member 17 without striking the lower heating member 14. A portion of the upper heating member 17 is made by mixing alumina ceramics of a round shape and a heating member of a fan shape to extend a period of time that holds the heat after heat absorption.

It will be appreciated that the heat element may be installed in multi-stage to enlarge the heating area if the present invention having the above construction is used as a heating element for a boiler, a heating furnace, and the likes requiring a large quantity of heat.

Moreover, the cover 18 installed at the top of the heating element body 11 has a number of legs 18*a* at the bottom thereof. The legs 18*a* are forcedly inserted into the heating element body 11 to form exhaust openings 20 between the heating element body 11 and the cover 18. According to the length of the legs 18*a*, which is inserted into the body 11, the volume of the exhaust openings 18*a* can be adjusted.

Furthermore, the heating element body 11 has vent holes 19 formed on the surface at regular intervals and the supporters 10 installed at the lower portion of the body 11 keep the body 11 in a certain interval from the stand 9 to induce the air by a natural circulation.

The air induced into the heating element body 11 is led into the body 11 by a rising current of air and provides with oxygen for burning the incompletely burnt hexane. All hexane mixed with the brown gas is burnt completely while passing the heating members of high temperature 14 and 17. The hexane is converted into the minimum amount of carbon dioxide ($CO_2$) by the complete combustion. Therefore, there is no pollution problem.

When the brown gas burner 7 is fired after the valve 6 is opened, a long flame is formed from the brown gas 21. When the flame directly heats the shelf 13 and the heating member 14 located at the lower portion, the heating member 14 is heated above 1000 degrees by the thermal reaction property of the brown gas; and, thereby, flame 22 of high temperature is generated at the top of the heating member 14.

The flame 21 of the lower portion and flame 22 of some brown gas passed the lower heating member 14 heats the upper shelf 15 and the upper heating member 17. In the same principle as the lower portion, the whole upper portion is also heated, flame 23 of high temperature is generated at the top, and another flame 24 springs up from the exhaust openings 20. At this time, the flame 24 has blue color and does beautiful performance.

As described above, the whole heating element body 11 has light scarlet color and emits a vast heat.

Embodiment

To apply the present invention practically, the present invention was manufactured to fit to a heating element of "a barbecue apparatus using brown gas" (Korean Appln. No. 2000-0028444) invented by the same inventor as this invention and experimented.

The brown gas generator 1 was a model BS-1200 that generates brown gas of 1,200 l per hour. The heating element body 11 was manufactured to have a diameter of 104 mm and height of 280 mm for the heating element 8 to consume the brown gas of 1200 l per hour. The shelf 14 was made by bending the flat bar into a flat surface made of nickel-chromium steel. The lower heating member 14 was made by winding nichrome wire and by piling up into four stages in such a manner that a small space was formed at the center of the heating member 14.

In the same way as the lower portion, also at the upper portion, the shelf 16 was installed and the heating member 17 was made by winding nichrome wire and by piling up into three stages in such a manner that a flat surface was formed without any space at the center. A number of alumina ceramic balls were put on the heating member 17.

The heating element manufactured as the above was installed in place of the conventional heating element, which was installed inside the barbecue apparatus using brown gas, and experimented. The brown gas burner 7 was fired after the valve 6 was opened, and it was checked that gas was discharged from an end of the brown gas burner 7. As soon as the flame 21 of the brown gas began to heat the lower shelf 13 and the lower heating member 14 directly, the heating element was heated immediately and the whole heating member 14 was heated above 1000 degrees by the thermal reaction property of the brown gas. The flame of high temperature was generated at the upper portion of the heating member 14. The flame began to heat the upper shelf 16 and the upper heating member 17 with the flame of some brown gas passed the lower heating member 14. In the same way, the upper heating member 17 also began to be heated above 1000 degrees, and the flame of high temperature was generated at the top of the heating member 17; and, thereby, the cover 18 located at the top of the heating element was also heated.

At this time, because the exhaust openings 20 were formed appropriately by adjusting the location of the cover, the hexane, which was incompletely burnt although being very a small amount, was completely burnt inside the heating element by oxygen of the air. Therefore, there was no soot.

At this time, it was ascertained that, from outward appearance, the heating element was heated from the lower portion of the body 11 and then the flame also heated the cover while rising upward. The whole body 11 emitted light of light scarlet color and another flame 24 of blue color was generated from the exhaust openings 20, and thus the heating element emitted a vast heat as sufficient as we required.

As a result, a preheating period of time for elvan of the barbecue apparatus was only 12 minutes, and it was the time that reduced to one third in comparison with that of the conventional heating element.

As a result that a consumed amount of hexane used for preventing the backfire completely was measured, the hexane liquid of about 0.3 l was consumed when the brown gas of 1200 l was used. Therefore, the backfire was completely prevented by using the small amount of hexane.

EFFECTS OF THE INVENTION

As described above, according to the present invention, non-polluting heat energy is provided by using water that is safe and purified to realize the human's dream for use of water as fuel.

As water is a resource having energy above two and a half times as much as oil, it may be utilized highly as an alternative energy that can solve various problems such as air pollution, earth warming phenomenon, or others. The safe brown gas emits a vast heat using the thermal reaction property, so that a new energy breaking a typically fixed idea can be used in various devices.

As one embodiment that the heating device of the present invention is applied to the brown gas burning apparatus, the heating device was applied to the previously described barbecue apparatus and it was already commonly used. Therefore, anyone can ascertain directly the mystic phenomenon that water generates a pillar of fire while burning within the elvan heating furnace in the barbecue apparatus.

The heating device according to the present invention is the core technology+ of all applied products that use the brown gas as fuel and is used as a heat source for all brown gas boilers, heaters, heating furnaces and warm air circulators. Therefore, it is very useful invention and makes a purified energy, which does not induce environmental pollution. The present invention realized the human's dream of non-pollution through technical innovation.

While the present invention has been described with reference to the particular illustrative embodiments, it is not to be restricted by the embodiments, but only by the appended claims. It is to be appreciated that those skilled in the art can change or modify the embodiments without departing from the scope and spirit of the present invention.

What is claimed is:

1. A heating apparatus using thermal reaction of brown gas comprising:

a brown gas generator for generating brown gas;

a flame arrester for preventing backfire of the brown gas, the flame arrester connected to the brown gas generator;

means to contain liquid hexane, wherein the means to contain liquid hexane is the flame arrester;

a brown gas heating element connected to the flame arrester, wherein the brown gas heating element includes: a burner mounted inside the brown gas heating element, a body of a hollow form, a first heating element having a small opening at its center axis, a second heating element, wherein the liquid hexane is mixed with the brown gas at the flame arrester and the mixture is provided to the burner of the brown gas heating element to produce a flame;

wherein when the flame passes through the first heating element heating the element above 1000° C. by thermal reaction and creating a high temperature flame above the first heating element;

wherein the high temperature flame passes through the second heating element heating the element above 1000° C. by a second thermal reaction creating a blue flame which emits a vast heat.

2. A heating apparatus using thermal reaction of brown gas, the heating apparatus comprising:

a brown gas generator for generating brown gas, a flame arrester for preventing backfire of the brown gas, means to contain liquid hexane, wherein the means to contain liquid hexane is the flame arrester;

a heating element having a burner mounted inside and a body of a hollow form, and heating members, wherein the liquid hexane is introduced into the flame arrester and a small amount of hexane ($C_6H_{14}$) in the form of vapor is mixed with the brown gas, wherein the mixture is provided to the burner mounted inside the heating element and a brown gas flame formed at the burner directly heats into the heating members to lead a thermal reaction of the brown gas to produce heat, wherein a portion of the second heating member is made by mixing alumina ceramics of a round shape and a heating member of a fan shape.

3. A heating apparatus using thermal reaction of brown gas comprising:

a brown gas generator for generating brown gas;

a flame arrester for preventing backfire of the brown gas;

means to contain liquid hexane, wherein the means to contain liquid hexane is the flame arrester;

a heating element having a burner mounted inside, a body of a hollow form, a first heating member having a small opening at its center axis, and a second heating member, wherein the second heating member is positioned above the first heating member;

wherein the liquid hexane is introduced into the flame arrester and a small amount of hexane ($C_6H_{14}$) in the form of vapor is mixed with the brown gas, wherein the mixture is provided to the burner mounted inside the heating element and a brown gas flame formed at the burner directly heats into the small opening of the first heating members to lead a thermal reaction creating a high temperature flame above the first heating element;

wherein the high temperature flame passes through the second heating element creating a second thermal reaction that produces a vast heat.

* * * * *